United States Patent [19]

Heib et al.

[11] 3,974,220

[45] Aug. 10, 1976

[54] QUATERNARY AMMONIUM CORROSION INHIBITOR AND PETROLEUM DEMULSIFIER

[75] Inventors: Lorenz Heib, Hofheim, Taunus; Martin Hille, Bad Soden, Taunus, both of Germany

[73] Assignee: Hoechst Aktiengesellschaft, Frankfurt am Main, Germany

[22] Filed: Aug. 6, 1973

[21] Appl. No.: 386,229

[30] Foreign Application Priority Data

Aug. 8, 1972 Germany ..... 2238995
Aug. 8, 1972 Germany ..... 2238994

[52] U.S. Cl. ..... 260/569.6 P; 252/331; 252/344; 252/390; 252/392

[51] Int. Cl.[2] ..... C07C 92/02

[58] Field of Search ..... 260/567.6 P, 567.6 M

[56] References Cited

UNITED STATES PATENTS

| | | | |
|---|---|---|---|
| 2,759,975 | 8/1956 | Chiddix et al. | 260/567.6 M |
| 2,967,755 | 1/1961 | Keller | 260/567.6 P |
| 3,283,005 | 11/1966 | Abend et al. | 260/567.6 P |

*Primary Examiner*—Bernard Helfin
*Assistant Examiner*—James H. Reamer
*Attorney, Agent, or Firm*—Connolly and Hutz

[57] ABSTRACT

Compounds of the formula (I)

in which $R_1$ is alkyl, alkenyl, or alkylpheyl, $R_2$ is a bivalent aromatic radical, and $R_3$ is an alkylene, alkenylene, or alkylphenylene radical and $A^{(-)}$ stands for a halogen atom, are used as demulsifiers and corrosion inhibiting agents in crude oil refining.

4 Claims, No Drawings

QUATERNARY AMMONIUM CORROSION INHIBITOR AND PETROLEUM DEMULSIFIER

The present invention relates to a corrosion inhibitor and petroleum demulsifier.

In crude oil production the corrosion of the production equipment is a growing problem with increasing dilution with water of the conveyed oil The crude oils brought above ground contain varying amounts of corrosive constituents, such as carbon dioxide, hydrogen sulfide and water of different salinity. In general, corrosion is relatively immaterial at the onset of production when relatively pure oil is conveyed, but it gets rapidly worse with increasing dilution with water and in most oil fields it constitutes a serious problem. Even relatively small portions of water must be substantially separated from the crude oil before transportation in pipe lines, tank cars, or tankers. Owing to the mostly emulsion-like distribution of the water in the oil the use of demulsifiers is absolutely necessary. These demulsifiers do not influence essentially the corrosion, but they alter the wetting conditions in the equipment and may thus contribute indirectly to an increase in the corrosion rate.

The attack by corrosion of the crude oils can be substantially suppressed by the addition of suitable inhibitors. Besides the costs for the use of such inhibitors, most products known for this purpose have the drawback of having an emulfifying action and hence, they necessitate the use of higher amounts of demulsifier.

It has now been found that the compounds specified below act as corrosion inhibitors and simultaneously have a demulsifying effect. Thus, by adding a single product water is separated from the crude oil and simultaneously the production equipment is protected against corrosion. Surprisingly, it has also been found that mixtures of the compounds of formula I defined below with usual demulsifiers containing free hydroxy groups are often characterized by an improved efficiency in the demulsification and dehydration of the crude oil emulsions.

The present invention therefore provides a process for refining crude oil, especially for separating water with simultaneous corrosion inhibition, which comprises adding to the crude oil compounds of the formula I group, $R_2$ represents a bivalent aromatic radical of the formula

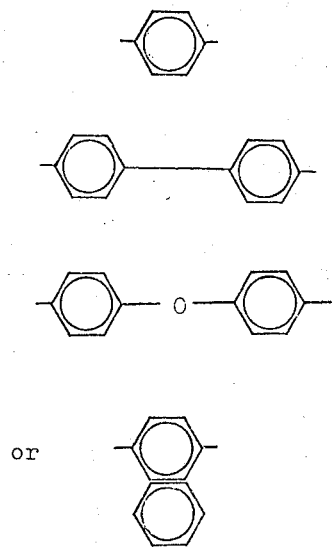

$R_3$, in the case of $n$ being 1, represents an alkylene or alkenylene radical having of from 5 to 24 carbon atoms or an alkylphenylene radical with 6 to 25 carbon atoms in the alkyl group, or in the case of $n$ being 2 to 6, $R_3$ represents an alkylphenylene radical having of from 6 to 25 carbon atoms in the alkyl group, $A^{(-)}$ stands for a halogen anion, preferably $Cl^{(-)}$ or $Br^{(-)}$.

For the preparation of the compounds of formula I in which $R_1$ and $R_3$ are aliphatic radicals 1 mole of a bis(-halogenomethyl)aromatic compound of formula II $$\text{Hal}-CH_2-R_2-CH_2-\text{Hal} \qquad \text{(II)}$$

in which $R_2$ hs the above meaning and Hal stands for a halogen atom, is reacted at elevated temperature, preferably in the range of from 70° to 110°C, with about 2 moles of a tertiary mono-alkyl-or-alkenyl-amino-polyglycol ether of formula III $$R_1-\left[CH_2-\underset{\underset{(C_2H_4O)_x-(C_3H_6O)_y-(C_2H_4O)_zH}{|}}{\overset{\overset{(C_2H_4O)_x-(C_3H_6O)_y-(C_2H_4O)_zH}{|}}{N^{(+)}}}-CH_2-R_2-CH_2-\underset{\underset{(C_2H_4O)_x-(C_3H_6O)_y-(C_2H_4O)_zH}{|}}{\overset{\overset{(C_2H_4O)_x-(C_3H_6O)_y-(C_2H_4O)_zH}{|}}{N^{(+)}}}-CH_2-R_3\right]_n-H \qquad \text{(I)}$$

$A^{(-)}$ $A^{(-)}$ in which $n$ is number of from 1 to 6, $x$ is 1 or 2, $y$ means a number of zero to 8, $z$ is number from 2 to 10, the sum of $x$ plus $z$ being equal to or greater than $y$ and preferably greater than 4, $R_1$, in the case of $n$ being 1, represents an alkyl or alkenyl radical having of from 5 to 24 carbon atoms, which may be linear or branched, or an alkylphenyl radical having of from 6 to 25 carbon atoms in the alkyl group, or $R_1$, in the case of $n$ being in the range of from 2 to 6, represents an alkylphenyl radical having of from 6 to 25 carbon atoms in the alkyl $$R_1N\begin{matrix}(C_2H_4O)_x-(C_3H_6O)_y-(C_2H_4O)_zH \\ (C_2H_4O)_x-(C_3H_6O)_y-(C_2H_4O)_zH\end{matrix} \qquad \text{(III)}$$

in which $R_1$, $x$, $y$, and $z$ have the above meanings. The quaternizing reaction can also be effected in the presence of water or of an inert organic solvent. In general, it is terminated after 6 to 20 hours.

To prepare compounds of formula I in which $R_1$ and $R_3$ represent alkylphenyl or alkylphenylene radicals 1 mole of a bis(halogenomethyl) aromatic compound of the formula II cited above is reacted with about 2 moles of diethanol amine at about 50° to 110°C, while thoroughly stirring, in the presence of an acid acceptor, for example sodium hydroxide, sodium carbonate, or the like. The reaction is suitably carried out in the presence of an inert organic solvent. In general, it is terminated after 1 to 6 hours. The reaction product is then separated from the precipitated inorganic halide and the solvent is removed by distillation. The reaction product obtained is reacted in known manner, in the presence of a suitable acid or basic catalyst, with ethylene oxide or propylene oxide and then with ethylene oxide; or with ethylene oxide, propylene oxide and ethylene oxide in this order of succession, to yield compounds of the formula IV

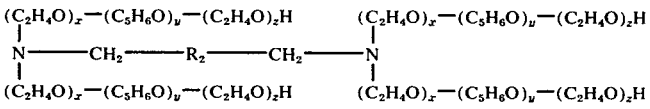

(IV)

The oxalkylation products obtained are then quaternized with a mixture of (a) alkylhalogenomethyl benzene and (b) alkyl-1,3-bis-(halogenomethyl)benzene a)

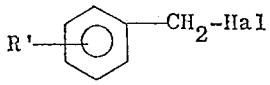

b)

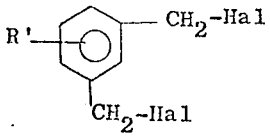

in which R′ represents an alkyl radical having of from 6 to 25 carbon atoms.

In this quaternizing reaction the ratio of the reaction components (a) and (b) influences the polymerization degree ($n$) of the final product. To prepare products of the formula I the mono- and bifunctional alkylhalogenomethyl benzenes (a) and (b) are expediently used in a molar ratio of a : b of from 1 : 10 to 2 : 1, for one mole of the oxalkylated tertiary amine IV.

Instead of or together with the compounds of formula I cross-linked products of the said compounds of formula I with themselves or with other known oil demulsifiers containing free hydroxy groups in the molecule can also be used for the purpose of the invention.

As cross linkage agents suitable for carrying out the cross linking reaction products having, for example, 2 or 3 reactive groups can be used which are suitable to react with the hydroxy groups of the components. Suitable cross-linking agents are, for example, di- or triisocyanates, such as toluylene di-isocyanate, dicarboxylic acids, such as adipic acid, phthalic acid, or sebacic acid, as well as phosphorus halides, such as phosphorus oxychloride and phosphorus trichloride. The cross linking reaction is effected in known manner by mixing the two components of the demulsifier mixture with the cross linking agent in approximately stoichiometric proportion at elevated temperature.

Demulsifiers containing hydroxy groups and suitable for cross linking are, for example, polypropylene oxide-polyethylene oxide block copolymers as described in French Patent No. 1,069,615 or so-called resin demulsifiers on the basis of alkylphenolformaldehyde resins which may have been reacted with propylene oxide and/or ethylene oxide. Products of this type are described, for example, in U.S. Pat. No. 2,557,081.

In the cross linking reaction the ratio of the compounds of formula I to the known demulsifiers containing hydroxy groups may vary within wide limits, in general, the ratio is in the range of from about 9 : 1 to 1 : 4, preferably 5 : 1 to 1 parts by weight. The amount of cross linking agent to be used is, in general, of from one-tenth to one-third mole for each hydroxy equivalent of the products to be cross linked with a trivalent cross linking agent, for example phosphorus trichloride. With the use of a bivalent cross linking agent the amount to be employed is about one-fifth to one-half mole, preferably one-fourth to one-third mole, for each hydroxy equivalent of the demulsifier to be cross linked.

It is also possible within the scope of the present invention to use the compounds of formula I in admixture with known crude oil demulsifiers. In this case, too, the block copolymers or demulsifiers on resin basis as used for the cross linking reaction are preferably used. In mixtures of this type the ratio of the two components, i.e. the compounds of formula I and the known crude oil demulsifiers, can also vary within wide limits, however, the content of compounds of formula I in the mixtures should be at least 20, preferably 70 to 90% by weight.

It has surprisingly been found that in many cases more than additive effects can be obtained in the demulsification of crude oils with such cross linking products or mixtures of the compounds of formula I with known crude oil demulsifiers.

The following examples illustrate the invention.

EXAMPLE 1

For preparing the compound of formula V

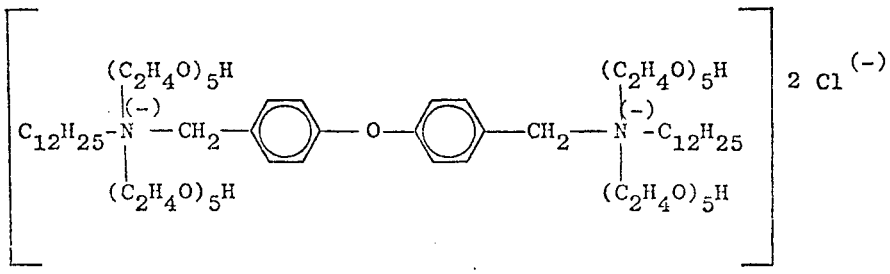

85 grams of diphenyl ether (0.5 mole) and 60 grams of paraformaldehyde (2 moles) were dispersed while stirring in 150 grams of glacial acetic acid and 180 grams of concentrated hydrochloric acid. At rising temperature, 80 grams of hydrogen chloride were introduced into the mixture. When a temperature of 70° to 75°C had been reached, this temperature was maintained while the introduction of hydrogen chloride was continued. The two phases obtained after the reaction were separated, and the lower phase containing the reaction product was repeatedly washed with water. 180 Grams of 4,4'-bis(chloromethyl)diphenyl ether were obtained.

780 Grams (1 mole) of tertiary dodecylamine polyglycol ether having 10 oxethyl groups in the molecule were added to the ether obtained and the mixture heated for 6 hours to 95°C. During this time the tertiary amino group was quaternized and the entire amount of organic chlorine was then present in ionic form as ascertained by analysis: Cl (total) 4.5 to 4.7 %, Cl (ionic) 4.5 to 4.7 %.

Under otherwise identical conditions the corresponding amount (0.5 mole) of p-xylylene chloride, 4,4'-bis(-chloromethyl)diphenyl or 1,4-naphthalene-bis-chloromethyl could be used instead of the diphenyl ether.

Instead of the dodecylamine polyglycol ether the corresponding amounts (1 mole) of the following compounds can also be used for the quaternizing reaction:

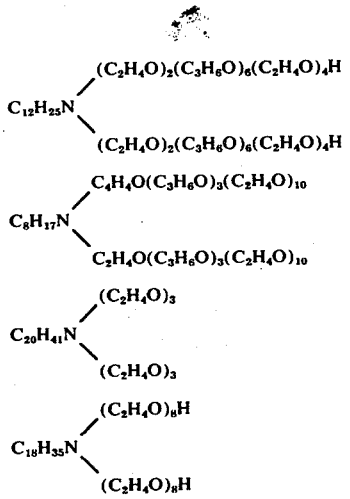

EXAMPLE 2

For preparing the compound of formula VI 86 grams (0.5 mole) of p-xylylene chloride were added in portions, at 90° to 100°C to 108 grams (a mole) of diethanol amine and 78 grams of sodium carbonate and the reaction mixture was stirred for 2 hours at 90° to 100°C. Next, 150 cc of isopropanol were added, the mixture was filtered with suction to separate the solution of the reaction product from the precipitated sodium chloride and the solvent was removed from the solution by distillation. 2 Grams of sodium methylate as catalyst were added to the reaction product which was then reacted at 150° to 160°C with 400 grams of ethylene oxide.

For quaternizing the oxalkylation product obtained 150 grams (0.5 mole) of 1,4-dodecyl-chloromethylbenzene and 87 grams (0.25 mole) of 6-dodecyl-1,3-bis(-chloromethyl)benzene were added and the mixture was heated to 90° to 100°C while stirring for 8 hours. A water-soluble reaction product of the above formula VI was obtained in which the total amount of chlorine was bound in ionic form (4.5% of ionic chlorine). According to formula VI the reaction product was obtained in the form of a mixture of mono-, bis- and terpolymers.

By variation of the ratio of dodecyl-chloromethyl benzene and dodecyl-bis(chloromethyl)benzene in the reaction the degree of polymerization of the final product can be varied. With a ratio of 1 : 1 of the mono- and difunctional alkyl-chloromethyl-benzenes, for example, a 4,5,6-polymeric final product is obtained.

In the aforesaid reaction, instead of p-xylylene chloride the corresponding amount of 4,4'-bis(chloromethyl)diphenyl ether, 4,4'-bis(chloromethyl)diphenyl or 1,5-bis(chloromethyl) naphthalene can be used under otherwise identical conditions.

It is furthermore possible to vary the oxalkylation degree within the indicated limits and optionally to add propylene oxide prior to the reaction with ethylene oxide, or to carry out the reaction alternately with ethylene oxide and propylene oxide.

In general, the compounds of formula I are highly viscous liquids. For practical use as crude oil demulsifiers and corrosion inhibitors they are mostly used in the form of solutions, preferably in lower alcohols containing about 1 to 4 carbon atoms. In the oil field or refinery the concentrated solutions of the compounds of formula I or their mixtures or cross linked products with known oil demulsifiers may be further diluted with alcohols or water. The amount of compounds of formula I, mixtures thereof or cross-linked products with known oil demulsifiers to be added to the crude oil substantially depends on the local conditions. In general, the demulsifiers and corrosion inhibitors ac-

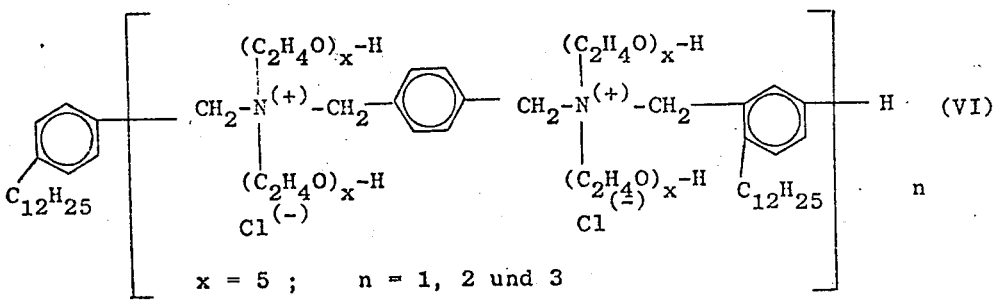

(VI)

coridng to the invention are used in an amount of about 2 to about 100 grams, preferably 5 to 50 grams for each (metric) ton of crude oil.

Owing to the fact that the compounds of formula I are substantially contained in the aqueous phase of the oil emulsions, the separated water, which is preferably used for flooding in the oil field, and the residual amount of water in the oil contain a sufficient amount of the product having an anti-corrosive action so that the inhibition of corrosion in the installation and transportation means such a tanks, input conduits, tank cars and pipelines is ensured.

EXAMPLE 3

Tests were carried out to compare the demulsifying action and the influence on the corrosion rate of the following products:

A. Propylene oxide-ethylene oxide block copolymer composed of 60% by weight of propylene oxide and 40% by weight of ethylene oxide and having a polypropylene glycol "nucleus" of a molecular weight of about 2,000 (comparative product, commercial demulsifier)

B. Condensation product of 1 mole of compound A, 0.75 mole of toluylene diisocyanate and 0.125 mole of an addition compound of ethylene oxide on a nonylphenol/formaldehyde resin, 5 ethylene oxide units being present for each phenol nucleus (comparative product, commercial demulsifier)

C. Addition product of ethylene oxide on a nonylphenol/formaldehyde resin with 5 ethylene oxide units for each phenol nucleus (comparative product, commercial demulsifier)

D. Compound of formula I in which $—CH_2—R_1$ and $—CH_2—R_3$ each stands for the octadecene-(8)-yl radical, $R_2$ represents the 1,4-phenylene radical, $y$ is zero, $n$ is 1, the sum of $x$ and $z$ is 5 and A means $Cl^{(-)}$ E. Compound of formula I in which $—CH_2—R_1$ and $—CH_2—R_3$ each stands for a coconut oil alkyl radical (mixture of $C_8$ to $C_{18}$ alkyl radicals), $R_2$ represents the 4,4'-diphenyl ether radical, $n$ is 1, $y$ is zero, the sum of $y$ and $z$ is 5 and A means $Cl^{(-)}$ F. Compound of formula I in which $—CH_2—R_1$ and $—CH_2—R_3$ each stands for the $C_{18}$ alkyl radical, $R_2$ represents the 1,4-naphthylene radical, $n$ is 1, $y$ is zero, the sum of $x$ and $z$ is 5 and A means $Cl^{(-)}$ G. Compound of the formula I in which $—CH_2—R_1$ and $—CH_2—R_3$ each stands for the $C_{12}$ alkyl radical, $R_2$ is the 4,4'-diphenyl radical, $n$ is 1, $x$ is 2, $y$ is 6 and $z$ is 4 and A means $Cl^{(-)}$ H. Compound of formula I in which $—CH_2—R_1$ and $—CH_2—R_3$ each stands for the $C_8$ alkyl radical, $R_2$ represents the 4,4'-diphenyl ether radical, $n$ is 1, $x$ is 1, $y$ is 3, $z$ is 10 and A means $Cl^{(-)}$ I. Compound of formula I in which $—CH_2—R_1$ and $—CH_2—R_3$ each stands for a $C_{20}$ to $C_{22}$ alkyl radical, $R_2$ represents the 1,4-phenylene radical, $n$ is 1, $y$ is zero, the sum of $x$ and $z$ is 3 and A means $Cl^{(-)}$ K. Compound of formula I in which $—CH_2—R_1$ and $—CH_2—R_3$ each stands for the octadecene (8)-yl radical, $R_2$ represents the 1,4-naphthylene radical, $n$ is 1, $y$ is zero, $x + z$ is 8 and A means $Cl^{(-)}$ L. Mixture of 4 parts by weight of product E with 1 part by weight of product B M. Cross linked product of 1 mole of product E with 1 mole of product C obtained with the use of two-thirds mole of phosphorus oxychloride as cross linking agent N. Compound of formula I in which $R_1$ represents the 4-tetra-isopropyl-phenyl radical, $R_2$ represents the 1,4-phenylene radical, $R_3$ stands for the 6-tetra-isopropyl-1,3-phenylene radical, $y$ is zero, the sum of $x$ and $z$ is 5, $n$ is 1 to 4 and A means $Cl^{(-)}$ O. Compound of formula I in which $R_1$ represents a 4-tetraisopropylene($C_{12}H_{25}$alkyl)phenyl radical, $R_2$ represents the 1,4-phenylene radical, $R_3$ stands for the 6-tetraisopropyl-1,3-phenylene radical, $y$ is zero, the sum of $x$ and $z$ is 7, $n$ is 3 to 5 and A means $Cl^{(-)}$ P. Compound of formula I in which $R_1$ represents the 4-tetra-isopropylene-phenyl radical, $R_2$ represents the 1,4-phenylene radical, $R_3$ stands for the 6-tetra-isoproylene-1,3-phenylene radical, $y$ is zero, the sum of $x$ and $z$ is 3, $n$ is 3 to 5 and A means $Cl^{(-)}$ Q. Compound of formula I in which $R_1$ represents the 4-octyl-phenyl radical, $R_2$ represents the 4,4'-diphenyl radical, $R_3$ stands for the 6-octyl-1,3-phenylene radical, $x$ is 1, $y$ is 3, $z$ is 8, $n$ is 1 to 4 and A means $Cl^{(-)}$ R. Compound of formula I in which $R_1$ is a $C_{20}$-22 alkyl-phenyl radical, $R_2$ is the 4,4'-diphenyl ether radical, $R_3$ represents, a $C_{20-22}$alkylphenyl radical, $x$ is 2, $y$ is 8, $z$ is 5, $n$ is 1 to 4 and A means $Cl^{(-)}$ S. Mixture of 4 parts by weight of product 0 with 1 part by weight of product B T. Cross linked product of 1 mole of product 0 with 1 mole of product C using two/thirds mole of phosphorus oxychloride as cross linking agent.

The demulsification tests were carried out at 70°C with a crude oil emulsion from Upper Bavaria (Germany) having a total content of 30% of water. In a shaking cylinder the product to be tested was added to the crude oil emulsion in an amount of 25, 50 and 75 mg/l, respectively, and the separated amount of water was determined in percent by volume after 1 hour, 2 hours and 3 hours. The results obtained are summarized in the following Table 1.

Without the addition of a demulsifer no water separated under the test conditions.

To determine the anti-corrosive effect weighed metal strips of carbon steel having a surface of 20 $cm^2$ were dipped for 6 hours at 60°C into 20% aqueous sodium chloride solutions containing 10 mg/l, 20 mg/l and 30 mg/l, respectively, of the product to be tested. During the test a continuous current of carbon dioxide was bubbled through the test solutions. The absolute loss in weight of the test strips determined after 6 hours was a measurement for the corrosivity of the test solutions. The results obtained are summarized in the following Table 2.

The results of Tables 1 and 2 indicate that the products used in accordance with the invention have the characteristic properties of a good corrosion inhibitor and simultaneously act as a demulsifier. The products allow of keeping low the damages by corrosion in crude oil production and refining equipment.

TABLE 1

| Product | amount used mg/l | % of water separated after 1 hr | 2 hrs | 3 hrs |
|---|---|---|---|---|
| A | 25 | 18 | 19 | 21 |
| | 50 | 20 | 22 | 24 |
| | 75 | 23 | 24 | 25 |

TABLE 1-continued

| Product | amount used mg/l | % of water separated after 1 hr | 2 hrs | 3 hrs |
|---|---|---|---|---|
| B | 25 | 6 | 16 | 22 |
| | 50 | 20 | 22 | 24 |
| | 75 | 23 | 25 | 26 |
| C | 25 | 16 | 18 | 23 |
| | 50 | 20 | 22 | 25 |
| | 75 | 22 | 24 | 26 |
| D | 25 | 15 | 17 | 19 |
| | 50 | 19 | 20 | 21 |
| | 75 | 21 | 22 | 23 |
| E | 25 | 20 | 21 | 21 |
| | 50 | 22 | 23 | 25 |
| | 75 | 24 | 25 | 26 |
| F | 25 | 3,5 | 12 | 14 |
| | 50 | 12 | 15 | 19 |
| | 75 | 19 | 23 | 24 |
| G | 25 | 3 | 8 | 12 |
| | 50 | 5 | 12 | 18 |
| | 75 | 7 | 15 | 21 |
| H | 25 | 9 | 12 | 17 |
| | 50 | 13 | 16 | 20 |
| | 75 | 18 | 20 | 22 |
| I | 25 | 4 | 7 | 19 |
| | 50 | 9 | 13 | 16 |
| | 75 | 12 | 16 | 18 |
| K | 25 | 11 | 17 | 20 |
| | 50 | 14 | 20 | 23 |
| | 75 | 17 | 22 | 24 |
| L | 25 | 6 | 18 | 27 |
| | 50 | 22 | 28 | 30 |
| | 75 | 27 | 30 | 30 |
| M | 25 | 21 | 23 | 24 |
| | 50 | 23 | 24 | 26 |
| | 75 | 25 | 26 | 28 |
| N | 25 | 19 | 21 | 23 |
| | 50 | 21 | 24 | 25 |
| | 75 | 25 | 26 | 26 |
| O | 25 | 16 | 18 | 20 |
| | 50 | 19 | 21 | 23 |
| | 75 | 22 | 23 | 25 |
| P | 25 | 10 | 12 | 13 |
| | 50 | 21 | 22 | 23 |
| | 75 | 22 | 23 | 24 |
| Q | 25 | 9 | 15 | 18 |
| | 50 | 13 | 18 | 21 |
| | 75 | 16 | 21 | 23 |
| R | 25 | 7 | 11 | 15 |
| | 50 | 11 | 16 | 18 |
| | 75 | 14 | 18 | 20 |
| S | 25 | 8 | 20 | 28 |
| | 50 | 24 | 29 | 30 |
| | 75 | 29 | 30 | 30 |
| T | 25 | 18 | 20 | 21 |
| | 50 | 21 | 26 | 28 |
| | 75 | 29 | 27 | 29 |

TABLE 2-continued

| Product | amount used mg/l | loss in weight mg |
|---|---|---|
| C | 10 | 34.4 |
| | 20 | 34.6 |
| | 30 | 34.5 |
| D | 10 | 3.4 |
| | 20 | 3.2 |
| | 30 | 2.7 |
| E | 10 | 4.1 |
| | 20 | 3.4 |
| | 30 | 3.0 |
| F | 10 | 7.6 |
| | 20 | 5.4 |
| | 30 | 4.5 |
| G | 10 | 25 |
| | 20 | 13 |
| | 30 | 8 |
| H | 10 | 22 |
| | 20 | 12 |
| | 30 | 5 |
| I | 10 | 2.5 |
| | 20 | 2.7 |
| | 30 | 3.1 |
| K | 10 | 14 |
| | 20 | 9 |
| | 30 | 4 |
| L | 10 | 5.3 |
| | 20 | 4.5 |
| | 30 | 3.8 |
| M | 10 | 10.5 |
| | 20 | 4.5 |
| | 30 | 4.0 |
| N | 10 | 4.4 |
| | 20 | 4.1 |
| | 30 | 3.6 |
| O | 10 | 5.3 |
| | 20 | 4.7 |
| | 30 | 4.1 |
| P | 10 | 5.6 |
| | 20 | 4.2 |
| | 30 | 3.8 |
| Q | 10 | 15 |
| | 20 | 9 |
| | 30 | 5 |
| R | 10 | 13 |
| | 20 | 18 |
| | 30 | 3 |
| S | 10 | 6.5 |
| | 20 | 5.0 |
| | 30 | 4.6 |
| T | 10 | 10.2 |
| | 20 | 5.3 |
| | 30 | 4.8 |

What is claimed is:

1. A compound of the formula

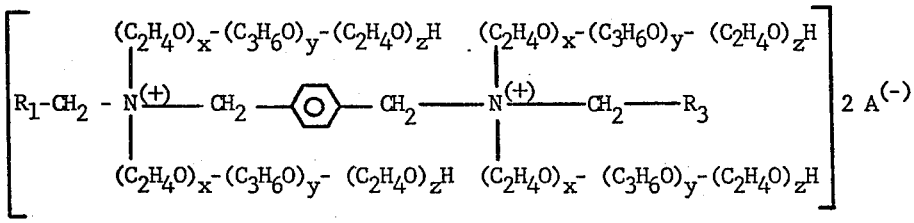

TABLE 2

| Product | amount used mg/l | loss in weight mg |
|---|---|---|
| A | 10 | 34.8 |
| | 20 | 34.1 |
| | 30 | 34.3 |
| B | 10 | 34.2 |
| | 20 | 34.5 |
| | 30 | 34.1 |

in which $x$ is 1 or 2, $y$ is zero to 8, $z$ is 2 to 10, the sum of $x$ plus $z$ being equal to or greater than $y$, $R_1$ and $R_3$ each are alkyl or alkenyl of 5 to 24 carbons and $A^{(-)}$ is halogen.

2. A compound of claim 1 wherein $A^{(-)}$ is $Cl^{(-)}$ or $Br^{(-)}\frac{1}{2}$ 3. The compound of the formula

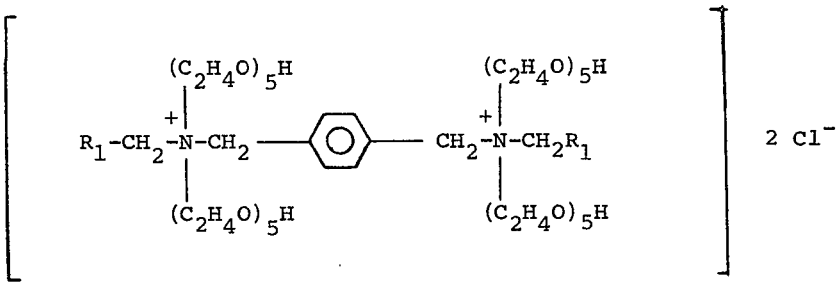
2 $Cl^-$
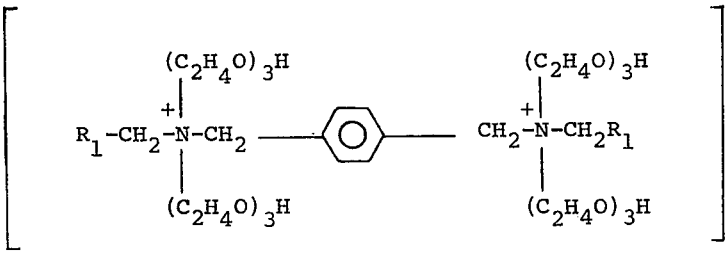
2 $Cl^-$
wherein $—CH_2—R_1$ means the octadecene-(8)-yl radical.
4. A compound of the formula
wherein $—CH_2—R_1$ means an alkyl radical having 20 to 22 carbon atoms.
* * * * *